US009581411B2

(12) United States Patent
Zusman

(10) Patent No.: US 9,581,411 B2
(45) Date of Patent: Feb. 28, 2017

(54) STOCK AND DETACHABLE ACCESSORY HOUSING FOR A SMALL ARMS WEAPON

(71) Applicant: Nisim Zusman, Ein Ayala (IL)

(72) Inventor: Nisim Zusman, Ein Ayala (IL)

( * ) Notice: Subject to any disclaimer, the term of this patent is extended or adjusted under 35 U.S.C. 154(b) by 0 days.

(21) Appl. No.: 14/676,663

(22) Filed: Apr. 1, 2015

(65) Prior Publication Data

US 2015/0276343 A1 Oct. 1, 2015

Related U.S. Application Data

(63) Continuation-in-part of application No. 29/496,645, filed on Jul. 15, 2014, now Pat. No. Des. 747,427, and a continuation-in-part of application No. 29/496,646, filed on Jul. 15, 2014, now Pat. No. Des. 748,216.

(60) Provisional application No. 61/973,831, filed on Apr. 1, 2014.

(51) Int. Cl.

| | |
|---|---|
| ***F41C 23/22*** | (2006.01) |
| ***F41C 23/04*** | (2006.01) |
| *F42B 39/02* | (2006.01) |

(52) U.S. Cl.

CPC ..... *F41C 23/04* (2013.01); *F41C 23/22* (2013.01); *F42B 39/02* (2013.01)

(58) Field of Classification Search

CPC ..... F41C 23/14; F41C 23/22; F41C 23/20; F41C 23/04; F41C 23/06; F41C 23/00

USPC ..... 42/71.01, 72, 73, 75.03, 49.01

See application file for complete search history.

(56) References Cited

U.S. PATENT DOCUMENTS

| | | | |
|---|---|---|---|
| 294,402 | A | 3/1884 | Onderdonk |
| 319,613 | A | 6/1885 | Onderdonk |
| 436,997 | A | 9/1890 | Quackenbush |
| 746,859 | A | 12/1903 | Marble |
| 922,173 | A | 5/1909 | Lovelace |
| 931,328 | A | 8/1909 | Marble |
| 961,511 | A | 6/1910 | Marble |
| 1,051,960 | A | 2/1913 | Kennedy |
| 1,035,490 | A | 2/1914 | Weathers |
| 1,156,293 | A | 10/1915 | Jorgenson |
| 1,174,840 | A | 3/1916 | Fisher |
| 1,485,456 | A | 3/1924 | Von Frommer |

(Continued)

FOREIGN PATENT DOCUMENTS

| | | | |
|---|---|---|---|
| CN | 300736403 | 1/2008 | |
| WO | WO 2008097308 A2 * | 8/2008 | ..... F14C 23/22 |

OTHER PUBLICATIONS

U.S. Appl. No. 61/360,487, filed Jun. 30, 2010, Zusman.

(Continued)

*Primary Examiner* — Benjamin P Lee

(74) *Attorney, Agent, or Firm* — Law Office of Arthur M. Antonelli, PLLC

(57) ABSTRACT

The present invention relates to a stock for a small arms weapon and a modular detachable accessory housing (DAH) for the stock. The DAH may be used to hold a tactical accessory (e.g., a magazine) or provide a closed container. The stock may define a profile which comprises a forward facing segment and a bottom facing segment. The forward facing segment and the bottom facing segment may intersect to form a step. The intersection of the forward facing segment and the bottom facing segment may define an oblique angle. The oblique angle may be an obtuse angle. The forward facing segment may include an accessory mounting rail. Also, the body of the stock may include a cylindrical cavity for receiving a receiver extension, a nested lever receiving cavity, as well as a bore that intersects the lever receiving cavity and the cylindrical cavity.

20 Claims, 12 Drawing Sheets

(56) References Cited

U.S. PATENT DOCUMENTS 1,526,847 A * 2/1925 Fritz ..... F41C 23/22 42/71.01
1,734,852 A 11/1929 Frampton et al.
1,822,875 A 9/1931 Ammann
2,098,139 A 11/1937 Foley et al.
2,400,422 A 5/1946 Johnson, Jr.
2,433,151 A 12/1947 Parsons
2,766,542 A 10/1956 Harvey
3,044,204 A 7/1962 Zimmerman
3,348,328 A 10/1967 Roy
3,618,248 A 11/1971 Into et al.
3,618,249 A 11/1971 Grandy
4,115,943 A * 9/1978 Musgrave ..... F42B 39/02 42/71.01
4,141,166 A 2/1979 Schultz
4,271,623 A 6/1981 Beretta
4,327,626 A 5/1982 McQueen
4,512,101 A 4/1985 Waterman, Jr.
4,551,937 A 11/1985 Seehase
4,697,367 A 10/1987 Brophy
4,735,007 A 4/1988 Gal
D324,557 S 3/1992 Livingston
5,209,215 A 5/1993 Morrison
5,225,613 A * 7/1993 Claridge ..... F41C 23/22 42/74
5,622,000 A 4/1997 Marlowe
5,711,102 A 1/1998 Plaster et al.
D391,334 S 2/1998 Plaster et al.
5,813,157 A * 9/1998 Scott ..... F41C 23/22 42/71.01
5,907,918 A 6/1999 Langevin et al.
6,250,194 B1 * 6/2001 Brandl ..... F41A 19/18 42/71.01
6,598,329 B1 7/2003 Alexander
6,598,330 B2 7/2003 Garrett et al.
6,651,371 B2 11/2003 Fitzpatrick et al.
6,779,289 B2 8/2004 Kay
6,829,855 B2 * 12/2004 Seifert ..... F41C 23/22 42/71.01
6,839,998 B1 1/2005 Armstrong
6,874,267 B2 4/2005 Fitzpatrick et al.
6,925,743 B1 8/2005 DiGiovanna
7,104,001 B1 9/2006 Digiovanna
7,131,228 B2 11/2006 Hochstrate et al.
7,152,355 B2 12/2006 Fitzpatrick et al.
7,162,822 B1 1/2007 Heayn et al.
7,337,573 B1 3/2008 Digiovanna
7,398,616 B1 7/2008 Weir
7,418,797 B1 9/2008 Crose
7,428,794 B2 9/2008 Oz
D584,373 S 1/2009 Young
D589,578 S 3/2009 Choma
D600,308 S 9/2009 Fitzpatrick et al.
7,587,852 B1 9/2009 Harms
D603,013 S 10/2009 Fitzpatrick et al.
D604,794 S 11/2009 Bentley
7,610,711 B2 11/2009 Oz
7,627,975 B1 12/2009 Hines
7,640,688 B2 1/2010 Oz
7,647,719 B2 1/2010 Fitzpatrick et al.
7,654,187 B2 2/2010 Hochstrate et al.
7,681,351 B2 3/2010 Bucholtz et al.
D616,056 S 5/2010 Bentley
7,743,544 B2 6/2010 Laney et al.
D620,067 S 7/2010 Saur
7,762,018 B1 7/2010 Fitzpatrick et al.
7,775,150 B2 8/2010 Hochstrate et al.
7,805,873 B2 10/2010 Bentley
7,810,270 B2 10/2010 Fitzpatrick et al.
7,823,313 B2 11/2010 Faifer
7,827,722 B1 11/2010 Davies
7,937,873 B2 * 5/2011 Keng ..... F41C 23/04 42/71.01
D640,342 S 6/2011 Fitzpatrick et al.
8,127,483 B2 3/2012 Kincel
8,127,485 B2 3/2012 Kincel
D661,366 S 6/2012 Zusman
8,191,299 B2 6/2012 Faifer
D668,311 S 10/2012 Rogers et al.
8,327,568 B1 * 12/2012 Lavergne ..... F41A 9/70 42/71.01
8,341,868 B2 1/2013 Zusman
D676,921 S 2/2013 Fitzpatrick et al.
8,387,298 B2 3/2013 Kincel
D683,808 S 6/2013 Elkaim
8,555,541 B2 10/2013 Ingram
D697,162 S * 1/2014 Faifer ..... D22/108
8,707,603 B2 * 4/2014 Troy ..... F41C 23/22 42/71.01
8,756,849 B2 * 6/2014 Troy ..... F41C 23/06 42/71.01
8,978,284 B1 3/2015 Zusman
2003/0110675 A1 6/2003 Garrett et al.
2003/0196366 A1 10/2003 Beretta
2003/0200693 A1 * 10/2003 Seifert ..... F41C 23/22 42/71.01
2004/0016167 A1 1/2004 Fitzpatrick et al.
2005/0108915 A1 5/2005 Kincel
2005/0235546 A1 * 10/2005 Wonisch ..... F41A 3/12 42/75.01
2005/0262752 A1 12/2005 Robinson et al.
2006/0096146 A1 5/2006 Fitzpatrick et al.
2006/0254414 A1 11/2006 Kuczynko et al.
2007/0261284 A1 * 11/2007 Keng ..... F41C 23/04 42/73
2008/0236016 A1 10/2008 Fitzpatrick et al.
2008/0236017 A1 10/2008 Fitzpatrick et al.
2008/0301994 A1 12/2008 Langevin et al.
2009/0139128 A1 6/2009 Fluhr
2009/0178325 A1 7/2009 Veilleux
2009/0241397 A1 10/2009 Fitzpatrick et al.
2009/0255161 A1 10/2009 Fitzpatrick et al.
2010/0115817 A1 5/2010 Faifer
2010/0180485 A1 7/2010 Cabahug et al.
2010/0192444 A1 8/2010 Cabahug et al.
2010/0192446 A1 8/2010 Darian
2010/0192447 A1 8/2010 Cabahug et al.
2010/0205846 A1 8/2010 Fitzpatrick et al.
2010/0229444 A1 9/2010 Faifer
2010/0251591 A1 10/2010 Burt et al.
2010/0275489 A1 11/2010 Cabahug et al.
2010/0300277 A1 12/2010 Hochstrate et al.
2011/0099872 A1 * 5/2011 Bentley ..... F41C 23/22 42/71.01
2011/0173863 A1 7/2011 Ingram
2011/0192067 A1 * 8/2011 Troy ..... F41C 23/20 42/73
2012/0000108 A1 1/2012 Zusman
2012/0042556 A1 2/2012 Vesligaj
2012/0079752 A1 4/2012 Peterson et al.
2012/0131829 A1 * 5/2012 Fistikchi ..... F41A 3/72 42/1.06
2012/0174455 A1 7/2012 Edelman et al.
2012/0174456 A1 * 7/2012 DePierro ..... F41C 23/22 42/71.01
2012/0174457 A1 7/2012 Edelman
2012/0180353 A1 7/2012 Holmberg
2013/0180148 A1 7/2013 Rodgers et al.
2014/0223791 A1 * 8/2014 Ruby ..... F41C 27/00 42/49.01
2015/0176943 A1 * 6/2015 Iervolino ..... F41C 23/16 42/2

OTHER PUBLICATIONS

U.S. Appl. No. 61/417,950, filed Nov. 30, 2010, Zusman.
Locarno (International Designs) search results: Class 22, Subclass 01, Jan. 10, 2011, pp. 1-16.

* cited by examiner

STOCK AND DETACHABLE ACCESSORY HOUSING FOR A SMALL ARMS WEAPON

CROSS REFERENCE TO RELATED APPLICATIONS

This application claims the benefit of U.S. Provisional Application No. 61/973,831 filed on Apr. 1, 2014, the disclosure of which is incorporated by reference herein in its entirety. This application is a continuation-in-part of application Ser. No. 29/496,645 filed Jul. 15, 2014, the disclosure of which is incorporated by reference herein in its entirety. Also, this application is a continuation-in-part of application Ser. No. 29/496,646 filed Jul. 15, 2014, the disclosure of which is incorporated by reference herein in its entirety.

FIELD OF THE INVENTION

The invention relates to a stock for a small arms weapon. More particularly, the invention relates to a stock and an accessory housing that may be secured to the stock. The accessory housing may be used to store tactical accessories or spare parts for a firearm.

BACKGROUND

Small arms may be defined as man-portable individual or crew-served weapon systems used against protected and unprotected personnel and light/unarmored vehicles. Man portable individual weapon systems such as an M4 carbine or AR-15 type firearm may be configured to mission requirements or individual preferences. For example, the stock of these weapons may be customized or adjusted for a user's size or preference. Adjustable stocks, however, may be connected loosely to these weapons, causing unwanted noise and movement. Additionally, these weapon systems may include laser pointers, fire control devices, night vision devices, optics, thermal weapon sights and other devices. Many of these accessories require one or more batteries to operate.

SUMMARY

Hence, the present invention is directed toward a stock of a small arms weapon having a modular detachable accessory housing (DAH). The DAH may be used to hold a tactical accessory (e.g., a magazine) or provide a closed container that may be used to store spare parts. Also, the present invention is directed toward a latch mechanism for adjusting the position of the stock on a receiver extension.

In one aspect, the stock for a small arms weapon may include a frame having a longitudinal axis. The frame may include a fore-end having a receiver extension attachment site opening, and a butt. The butt may be spaced from the fore-end along the longitudinal axis. The butt may include an upper area aligned with the receiver extension attachment site opening, an intermediate area situated next to the upper area, and a lower area disposed below the intermediate area. The intermediate area may include a rear opening having a Y-shaped cross-section transverse to the longitudinal axis, and the lower area may include a butt plate attachment site.

Further, the frame may include a body disposed between the fore-end and the butt. The body may include an upper surface extending from the upper area to the fore-end, as well as a lower surface extending from the lower area to the fore-end. Also, the body may include a cylindrical cavity situated in the body between the upper surface and the lower surface, which may be bounded by a sidewall and a track that are disposed between the receiver extension attachment site and the upper area such that the cylindrical cavity is configured and dimensioned to telescopically receive a receiver extension tube from the receiver extension attachment site opening. The lower surface of the body may define a profile which comprises a forward facing segment and a bottom facing segment. The forward facing segment and the bottom facing segment may intersect to form a step with respect to the longitudinal axis. The forward facing segment may include an accessory mounting rail. Further, the body may include a lever receiving cavity connected to the rear opening which extends toward the fore-end, as well as a bore that intersects the lever receiving cavity and the cylindrical cavity.

Additionally, the frame may include a stock latch lever pivotally disposed in the lever receiving cavity, and a locking pin situated in the locking pin bore, the locking pin extending from the lever receiving cavity into the cylindrical cavity such that the locking pin may be operatively associated with the stock latch lever to selectively withdraw the locking pin from the cylindrical cavity.

In another aspect, the lower surface of the stock body may include the intersection of the forward facing segment and the bottom facing segment to define an oblique angle. The oblique angle may be an obtuse angle.

In another aspect, the detachable accessory housing may be mounted on the accessory mounting rail of the stock body. The detachable accessory housing may include an accessory mounting rail attachment site. The accessory mounting rail attachment site may include a channel, a port side retention member adjacent to the channel, and a starboard side retention member opposite the port side retention member. The channel, portside retention member, and starboard side retention member may be configured and dimensioned to slidably mate with the accessory mounting rail. Additionally, the detachable accessory housing may include an accessory well.

The detachable accessory housing further may include an accessory latch having first and second operable configurations. In the first operable configuration, the accessory latch may project into the accessory well. In the second operable configuration, the latch may be withdrawn from the accessory well. The accessory latch may include a catch, a stem connected to the catch, a release button connected to the stem, and a resilient member disposed about the stem between the release button and the catch such that the resilient member biases the catch into the first configuration.

In another aspect, the detachable accessory housing may be fixed to the bottom facing segment by a fastener. In yet another aspect, the accessory well may comprise a four sided compartment. The four sided compartment may be configured and dimensioned to receive a box magazine. The box magazine may have a maximum capacity of ten rounds.

In yet another aspect, stock may include a back plate secured to the butt. The back plate may include a first side which faces the stock, and a second side which faces away from the stock. The first side may include a hook which is configured and dimensioned to be received in the butt plate attachment site. The second side may include an over molded layer of resilient material.

In another aspect, the present invention relates to a detachable accessory housing for a stock. The detachable accessory housing may include a cradle for holding an accessory. The cradle may include an accessory well, and an accessory mounting rail attachment site spaced from the accessory well. The accessory mounting rail attachment site may include a channel, a port side retention member adjacent the channel and a starboard side retention member opposite the port side retention member. The channel, the port side retention member, and the starboard side retention member may be configured and dimensioned to slidably mate with an accessory mounting rail.

The cradle further may comprise an accessory latch for securing an accessory in the well. The latch may include first and second operable configurations such that in the first operable configuration the accessory latch projects into the accessory well, and in the second operable configuration, the latch is withdrawn from the accessory well. The accessory well and latch may be configured and dimensioned to selectively fix a box magazine in the cradle.

DESCRIPTION OF THE DRAWINGS

In the accompanying drawings, which form a part of the specification and are to be read in conjunction therewith and in which like reference numerals (or designations) are used to indicate like parts in the various views.

DETAILED DESCRIPTION

Figure 1:
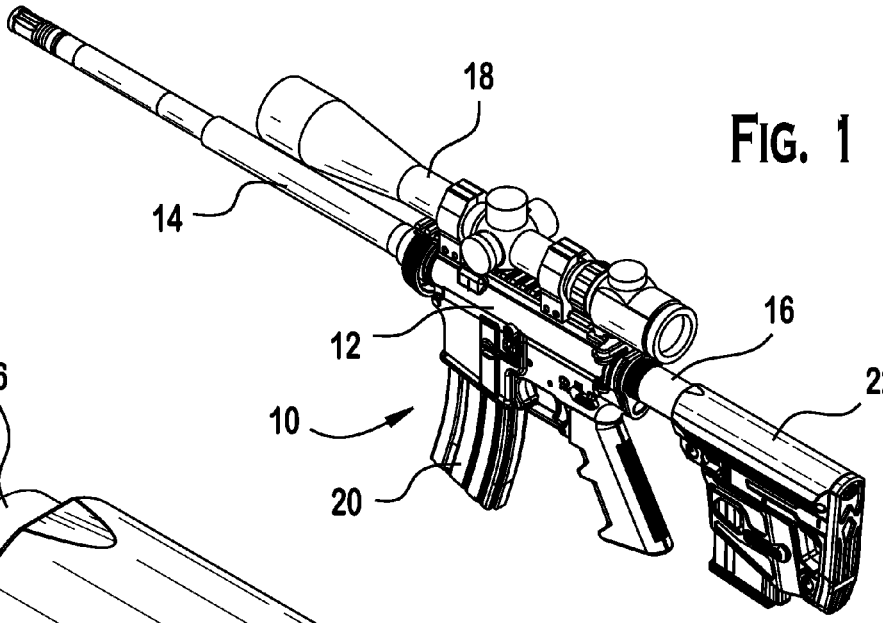
FIG. 1 is a perspective view of an AR-15 weapon platform with an embodiment of a small arms weapon stock and an exemplary detachable accessory housing (DAH) in accordance with the present invention, along with a rifle magazine disposed in the DAH.
Figure 2:
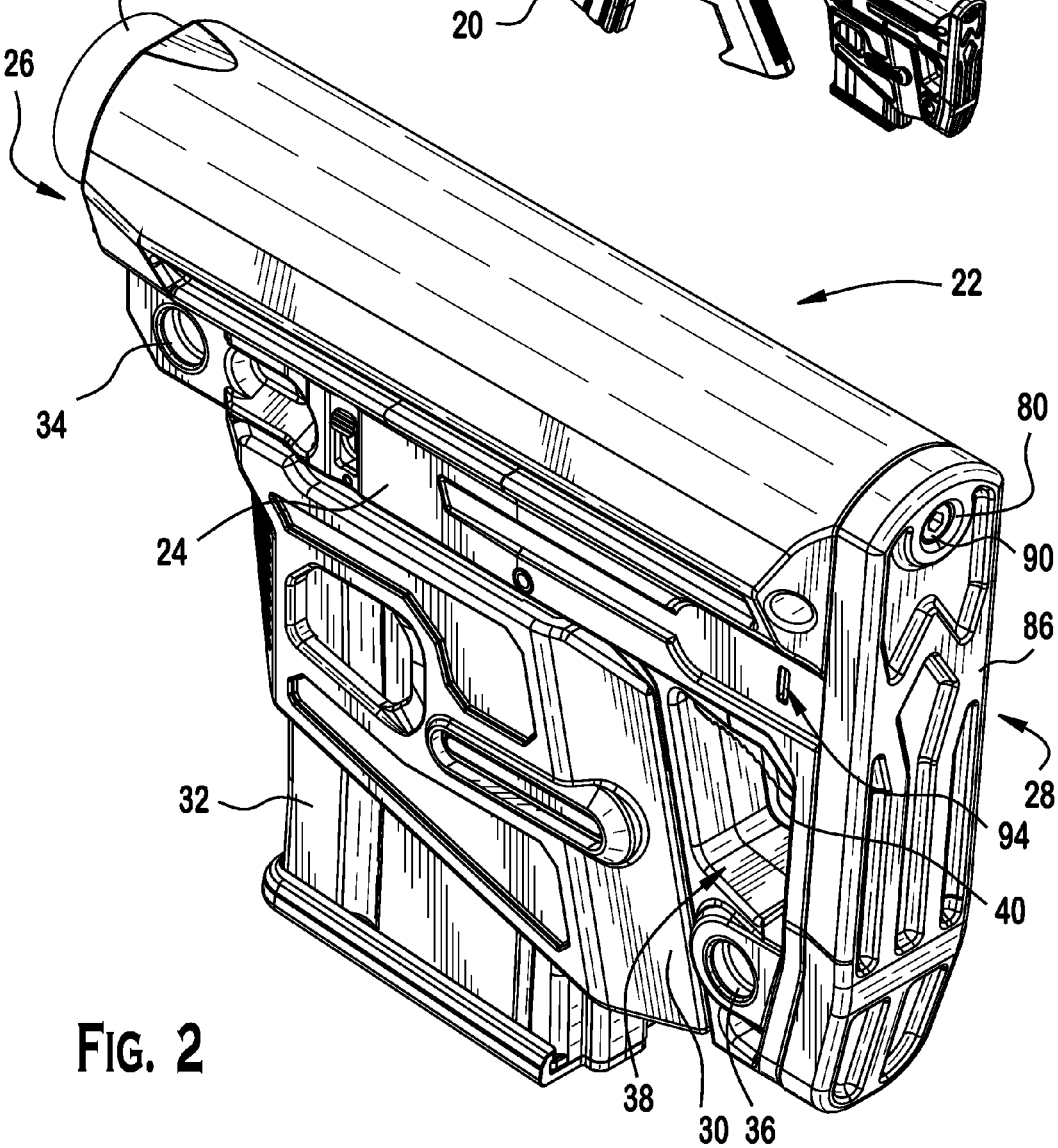
FIG. 2 is a perspective view of the stock and DAH of FIG. 1.
Figure 3:
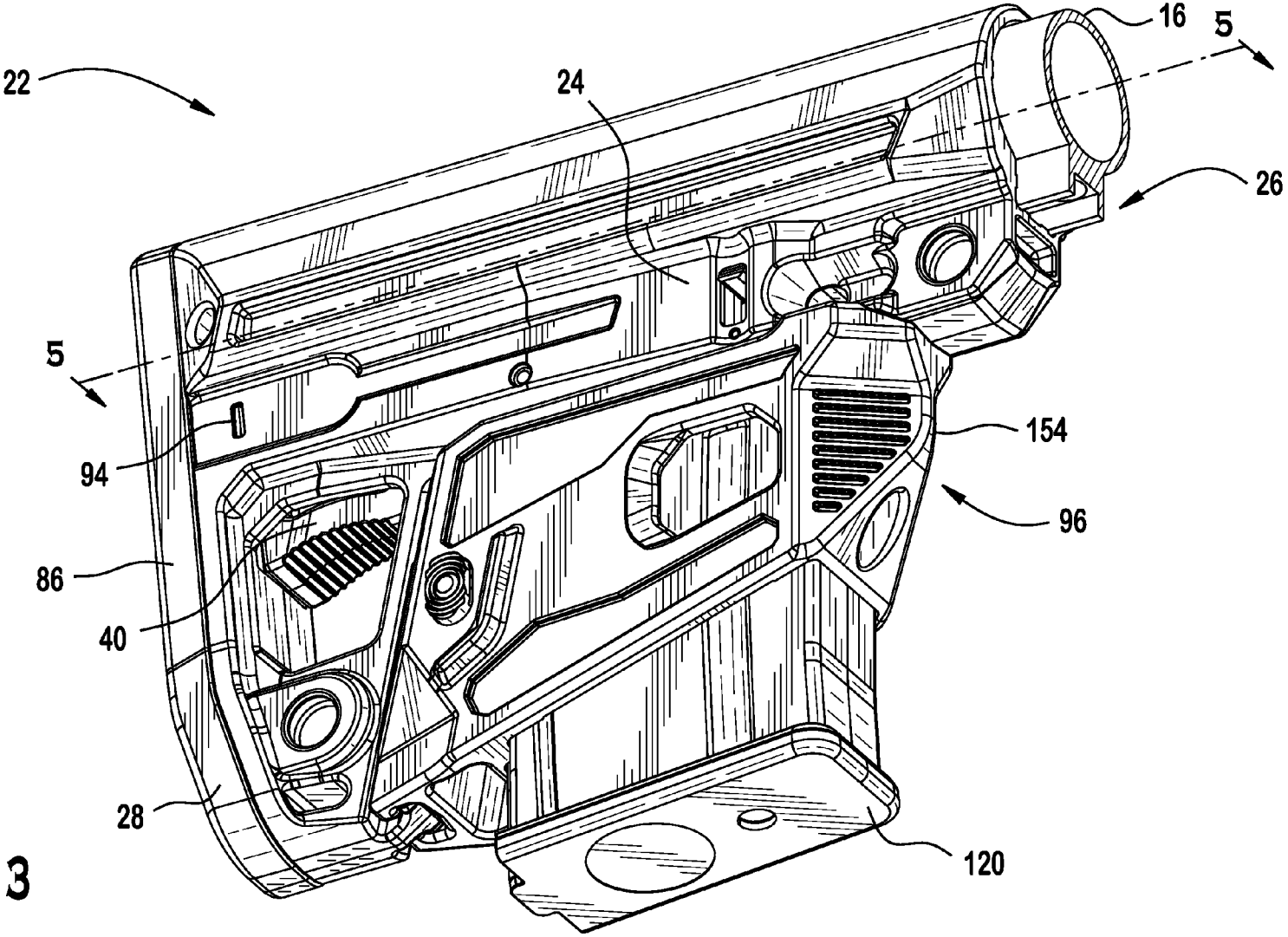
FIG. 3 is another perspective view of the stock and DAH of FIG. 1.

FIG. 1 shows an AR-15 type rifle 10. The firearm 10 may include a receiver 12, a barrel 14, a receiver extension 16, a telescopic sight 18, a magazine 20, and a stock 22 secured to the receiver extension 16. Referring to FIGS. 2 and 3, the stock 22 may include a frame 24, a receiver extension tube opening (or attachment site) 26, a replaceable back plate 28, a detachable accessory housing (DAH), and a 10 round, spare magazine in the DAH 32. The stock 22 further may include a bushing 34 at the distal end of the stock, as well as another bushing 36 at the lower part of the distal end. The bushings may be configured and dimensioned to receive a sling attachment fitting. The stock 22 may include a side opening 38 near the proximal end of the frame. The side opening 38 may pass from one side of the frame to the other side. A stock latch finger button 40 may be disposed in the side opening.

Figure 5:
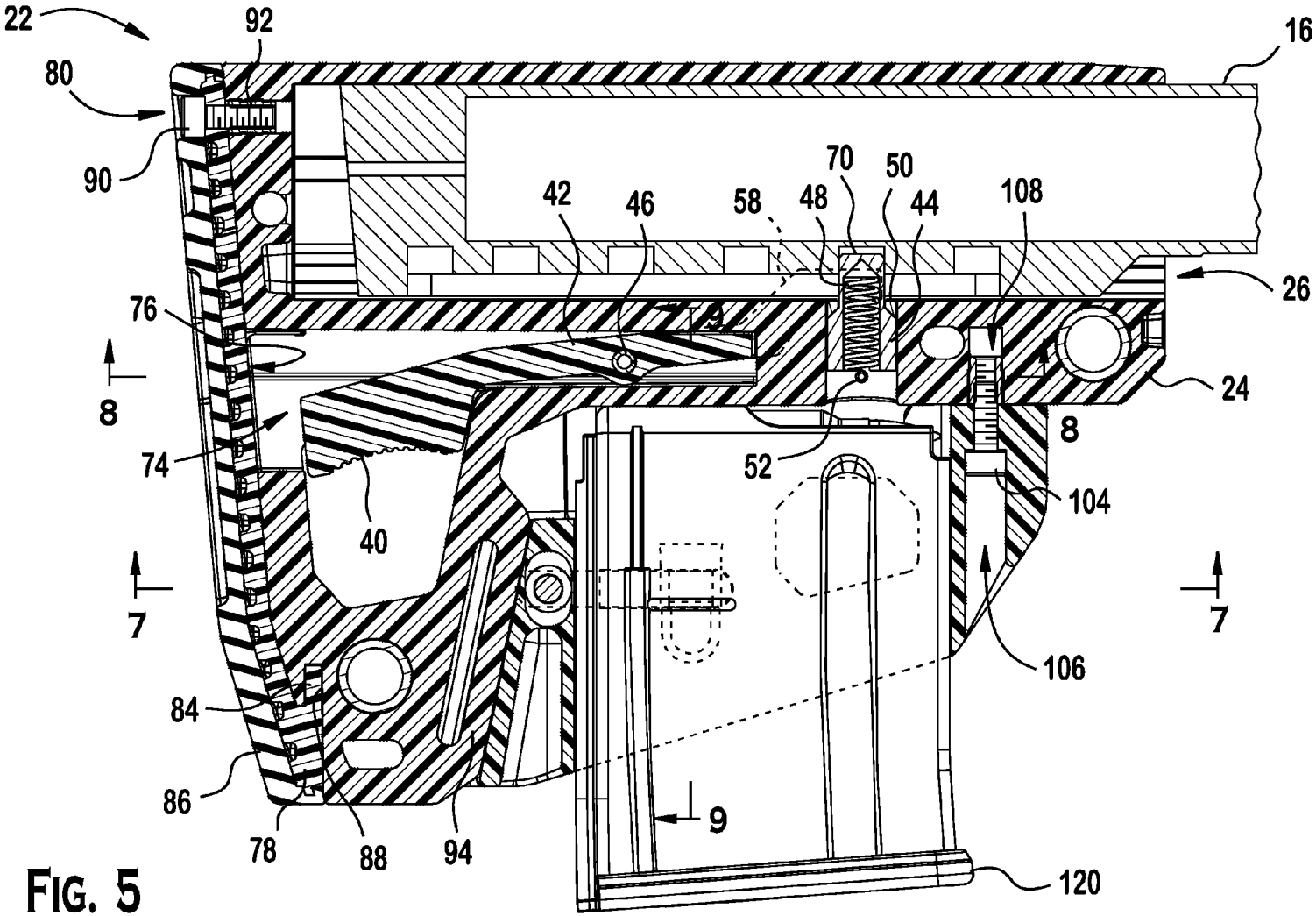
FIG. 5 is a cross-sectional view of the stock and DAH of FIG. 1, along line 5-5 of FIG. 3.
Figure 6:
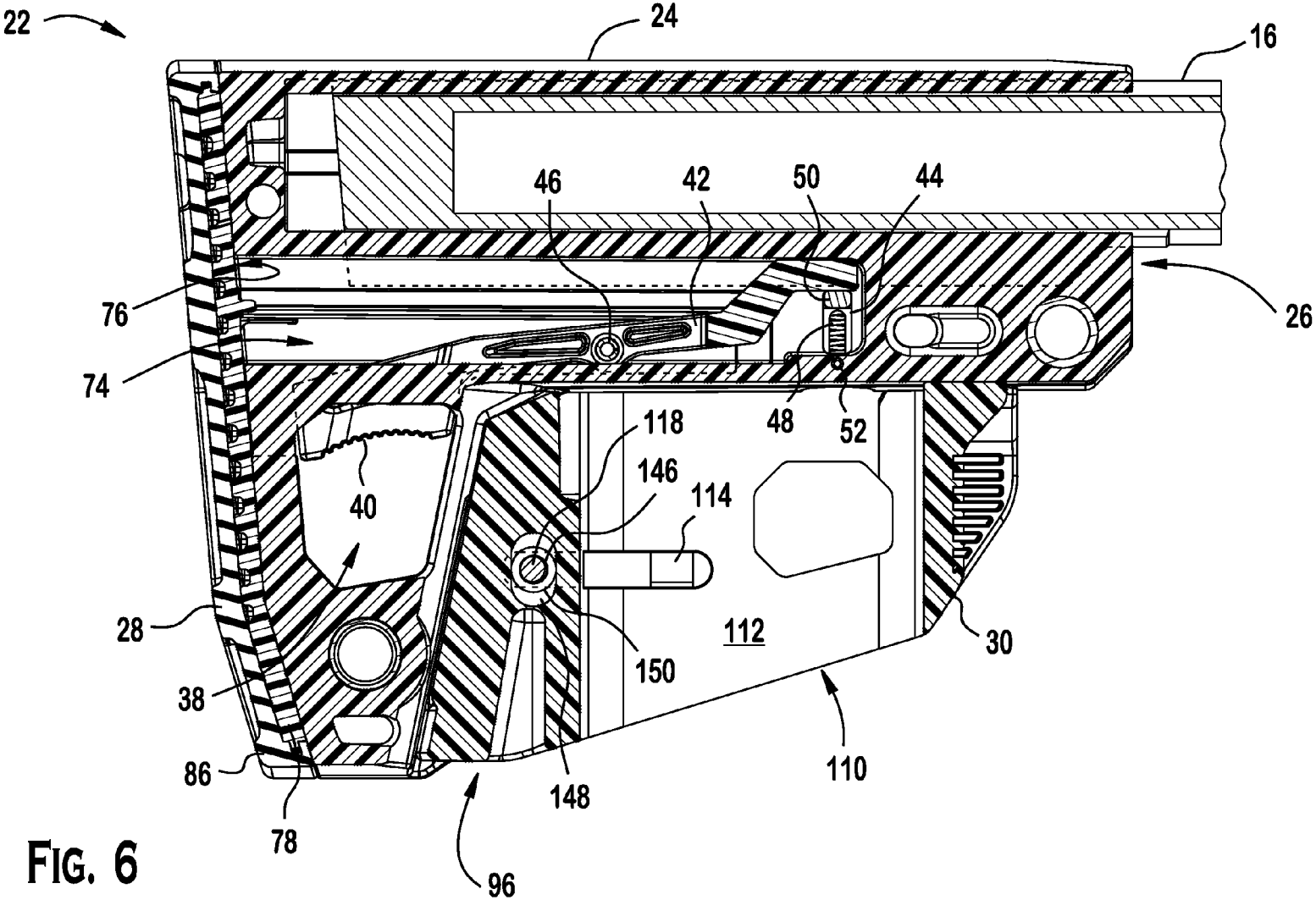
FIG. 6 is a cross-sectional view of the stock and DAH of FIG. 1, along line 6-6 of FIG. 4.
Figure 18:
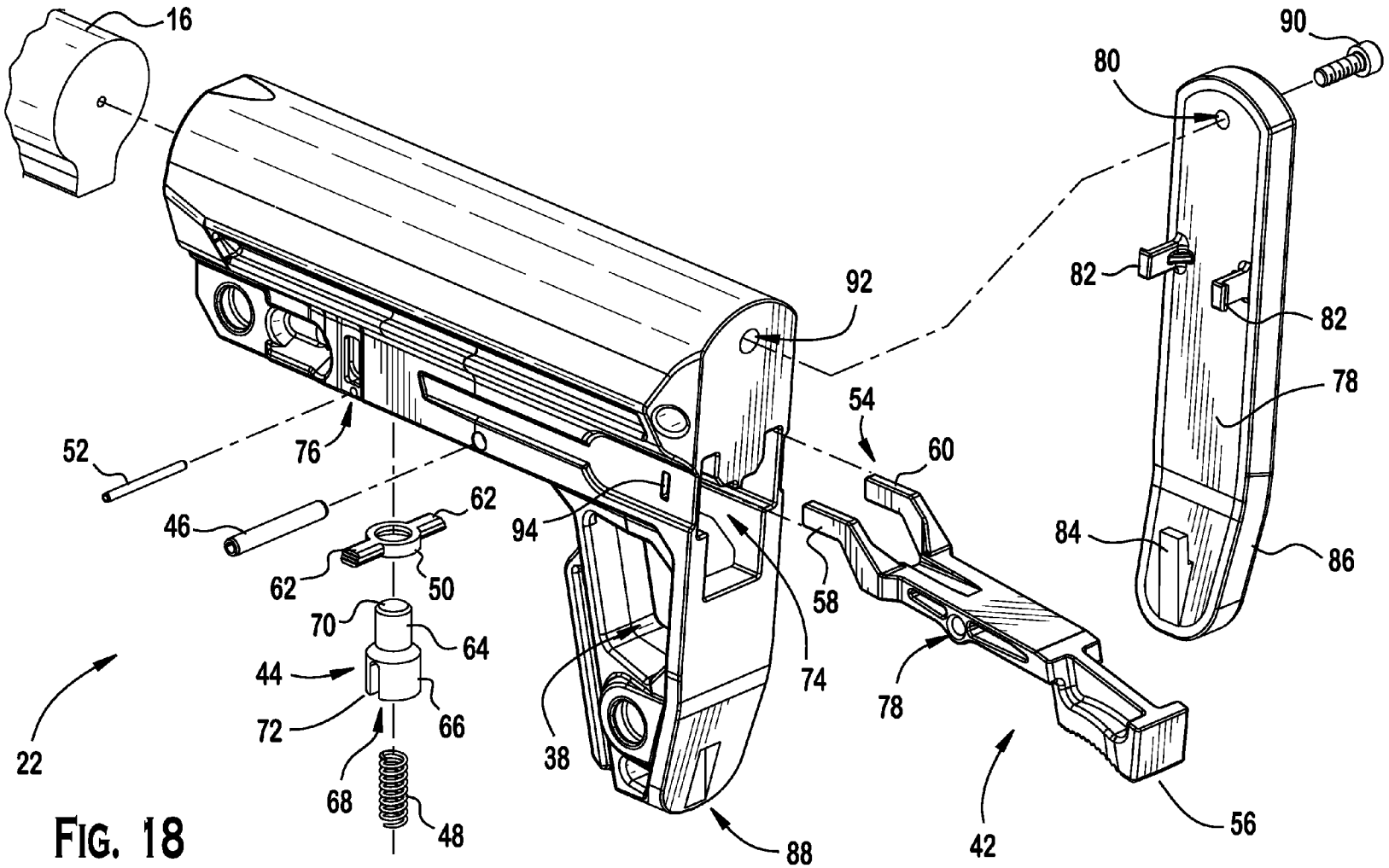
FIG. 18 is an exploded view of the stock of FIG. 11.

Referring to FIGS. 5 and 6, the stock latch finger button (or activation portion) 40 may be part of a lever 42 that is part of an assembly, which biases a stock latch locking pin 44 into the receiver extension tube attachment site 26, and which lowers the stock latch locking pin 44 out of the receiver extension attachment site 26 when the finger activation portion 40 of the lever 42 is pulled upward by a user. Referring to FIG. 18, the stock latch assembly may include a stock latch lever 42, a stock latch pivot pin 46, a stock latch locking pin 44, a stock latch compression spring 48, a stock latch ring pin 50, and a stock latch retention pin 52.

Figure 8:
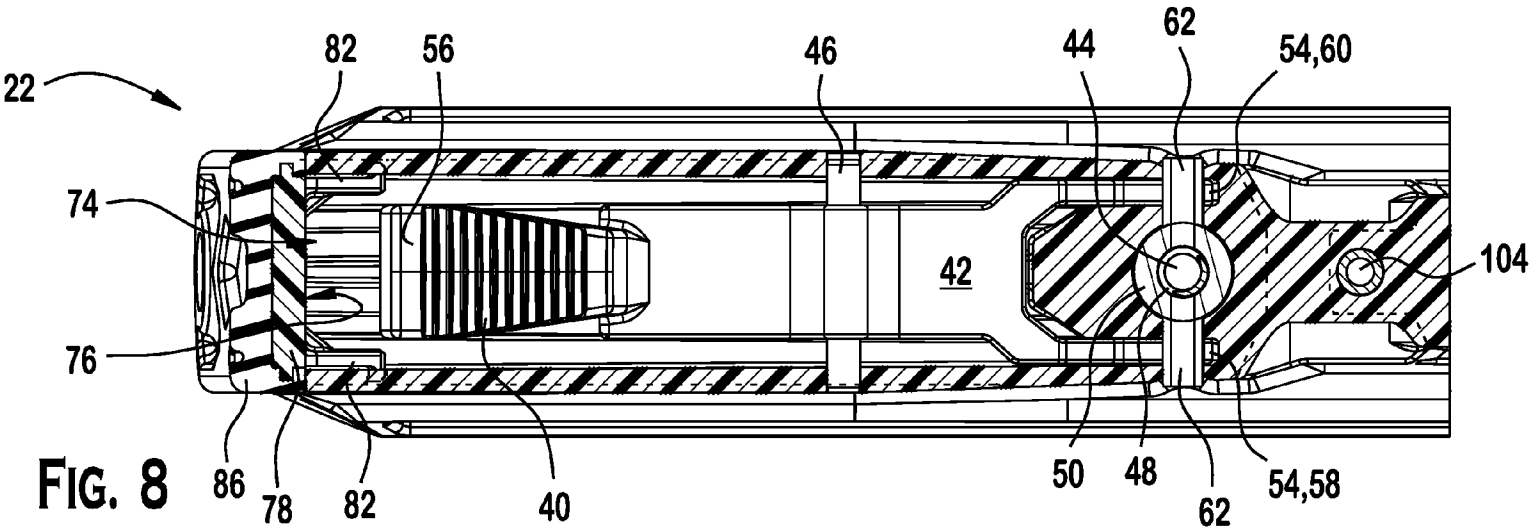
FIG. 8 is a cross-sectional view of the stock and DAH of FIG. 1, along line 8-8 of FIG. 5.
Figure 17:
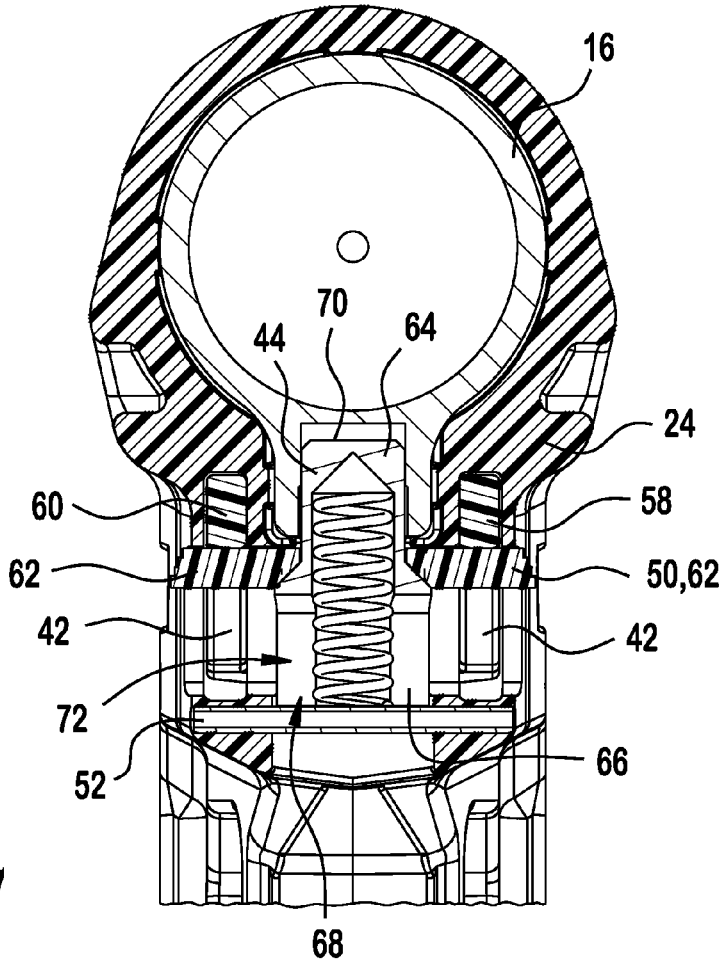
FIG. 17 is a cross-sectional view of the stock and DAH of FIG. 1, along line 17-17 of FIG. 6.

Referring to FIGS. 8 and 18, the stock latch lever 42 may include a locking pin end 54 and a finger end 56. The locking pin end 54 may include a port side arm 58 and a starboard side arm 60. The port side arm 58 and the starboard side arm 60 may rest on top of two lateral extensions 62 on the stock latch ring pin 50. As shown in FIGS. 17 and 18, the stock latch ring pin 50 may seat around the locking pin 44. The locking pin 44 may include an upper portion 64 with a first diameter and a lower portion 66 with a second diameter. The second diameter is larger than the first diameter. The ring pin 50 may seat around the upper portion 64 and rest on the lower portion 66. The locking pin 44 may be hollow and include an opening 68 at the bottom of the lower portion 66. The top 70 of the locking pin 44 may be closed. Additionally, the locking pin 44 may have a cross slot 72 in the lower portion. The stock latch compression spring 48 may be placed inside the locking pin 44 from the bottom opening 68 and secured within the opening with the stock latch retention pin 52.

Referring to FIG. 5, the locking pin 44 may be biased in an upward (or extended) position to fix the relative position of the receiver extension 16 with respect to the frame 24. By contrast, pulling upward on the stock latch finger button 40 rotates the lever 42 about the pivot pin 46. Referring to FIG. 17, the port side arm 58 and starboard side arm 60 of the stock latch lever 42 may push down on the lateral extensions 62 on the ring pin 50. The ring pin 50 may transfer downward force from the latch lever 42 to the locking pin 44, which in turn compresses the compression spring 48. In this manner, the locking pin 50 may be selectively retracted from the receiver extension tube attachment site 26. When the locking pin 50 is withdrawn, the stock 22 and the receiver extension tube 16 may slide with respect to each other.

Figure 10:
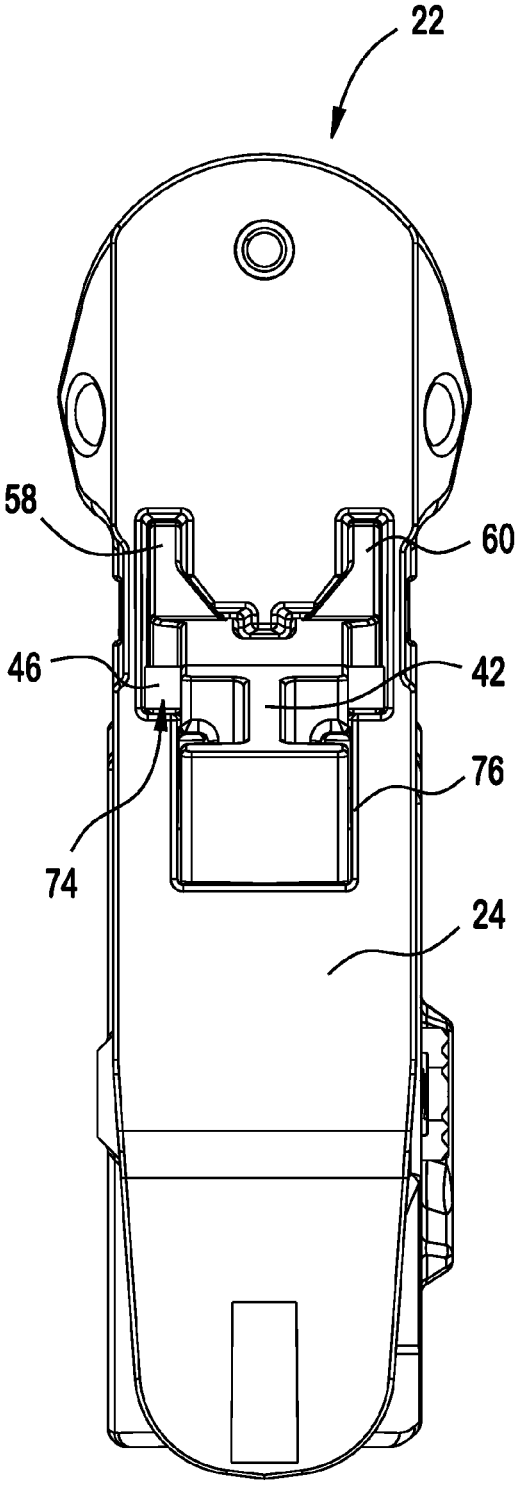
FIG. 10 is a rear side view of the stock of FIG. 1 with the back plate removed.

As shown in FIGS. 5, 6 and 10, the stock latch lever 42 may be disposed within a cavity 74 in the stock frame 24. The cavity 74 may be located below the receiver extension tube attachment site 26 and mostly proximal of the stock latch locking pin 44. Referring to FIG. 10, the stock latch lever 42 may be inserted into the cavity 74 from an opening on the rear side (proximal end) of the frame 24. Referring to FIG. 18, the stock latch lever 42 may be pinned into place through aligned openings 78 in the stock frame and a bore 78 in latch lever body.

Referring to FIGS. 6, 8 and 18, the opening 76 to the stock latch receiving cavity 74 may be closed with a rigid back plate 78. The rigid back plate 78 may include a fastener receiving bore 80 at the top of the back plate; two press fit connectors 82 for interfacing with the stock frame in a more central region of the back plate, and a hook 84 at the base of the rigid back plate. The back plate further may include a rubber coating or resilient cover 86, which may be formed by an over molding process. As shown in FIGS. 5 and 18, the hook 84 may interlock with an anchor portion 88 of the frame 24 to help secure the back plate 78 to the stock. Additionally, a fastener 90 may be used to secure the top portion of the back plate 78 to the proximal end portion of the stock frame 24 at a fastener attachment site 92. Moreover, referring to FIG. 5, the pair of press fit connectors 82 may interlock with slots 94 on opposing internal side walls of the stock latch receiving cavity 74 to enhance the connection.

Figure 11:
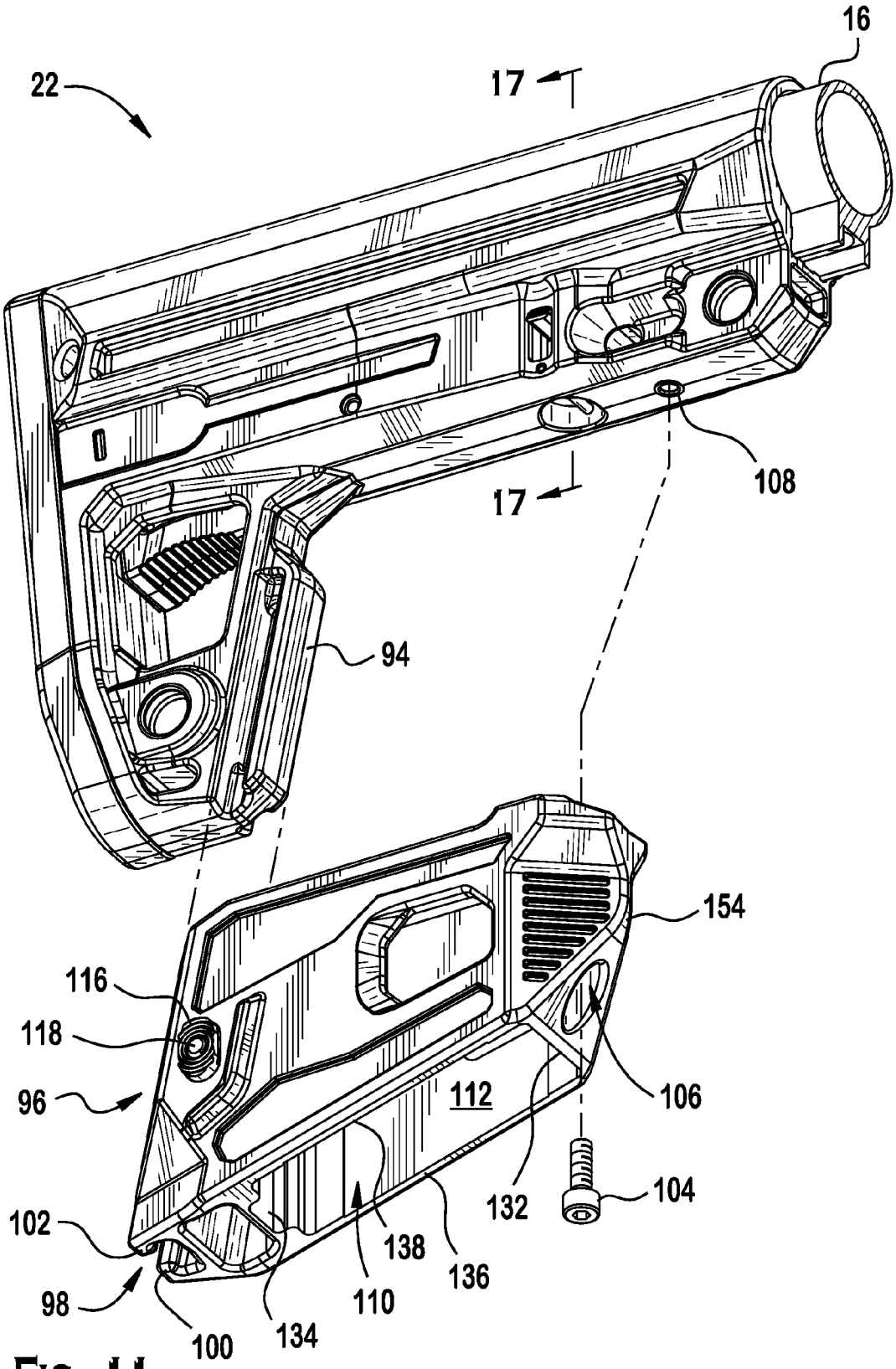
FIG. 11 is a partially exploded view of the stock of FIG. 4 with the stock and DAH disengaged.

Referring to FIG. 11, the stock frame 24 further may include an accessory mounting rail 94. The accessory mounting rail 94 may be T-shaped or some other form. Although the stock may be used in the configuration shown in FIG. 11, the accessory mounting rail 94 may provide the stock with the capability to securely receive an accessory, such as a pouch or holster device (or detachable accessory housing) 96, which may provide a way of storing tactical accessories with the stock.

Figure 12:
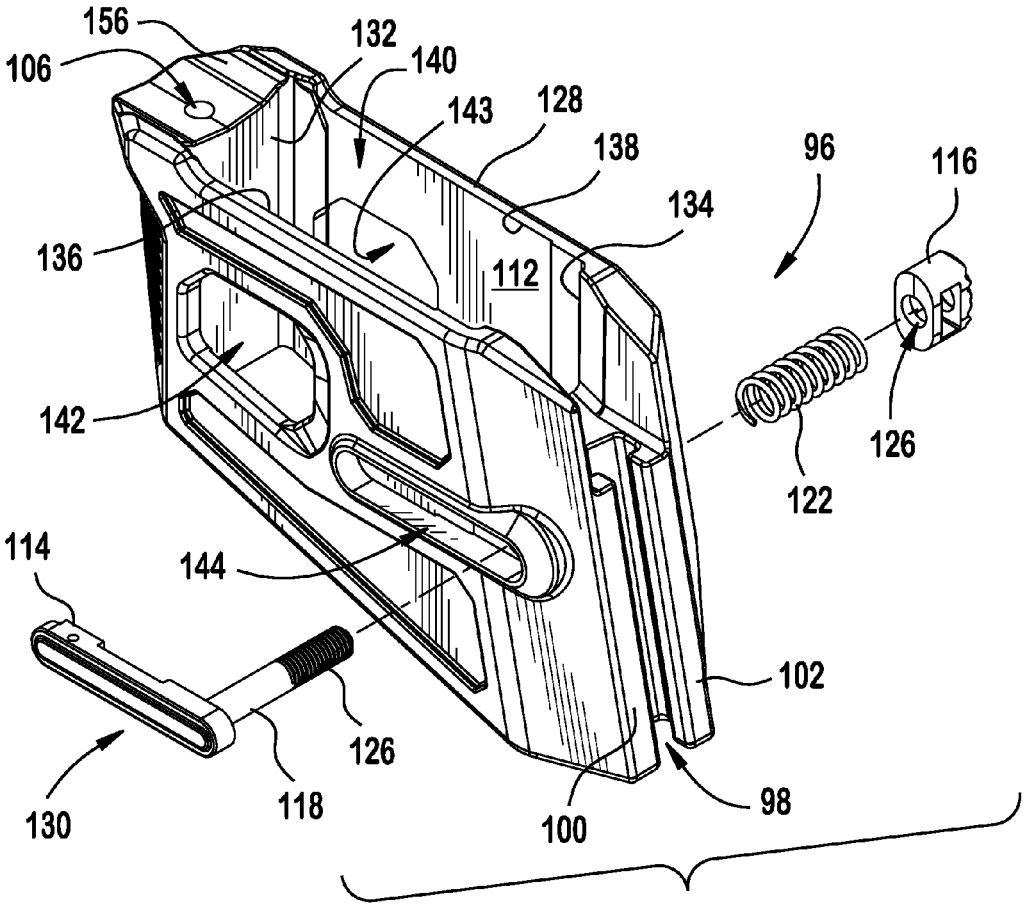
FIG. 12 is a perspective view of the DAH of FIG. 11.

Referring to FIGS. 11 and 12, the accessory mounting rail 94 may be configured and dimensioned to receive a channel structure 98 on the DAH. The channel may be formed, in part, by port side and starboard side retention members 100, 102, respectively. The accessory mounting rail may include recoil grooves, and the profile of the accessory mounting rail and the dimensions and spacing of the recoil grooves may conform to military standards, such as MIL-STD-1913 published by the US Department of Defense on Feb. 3, 1995.

Figure 7:
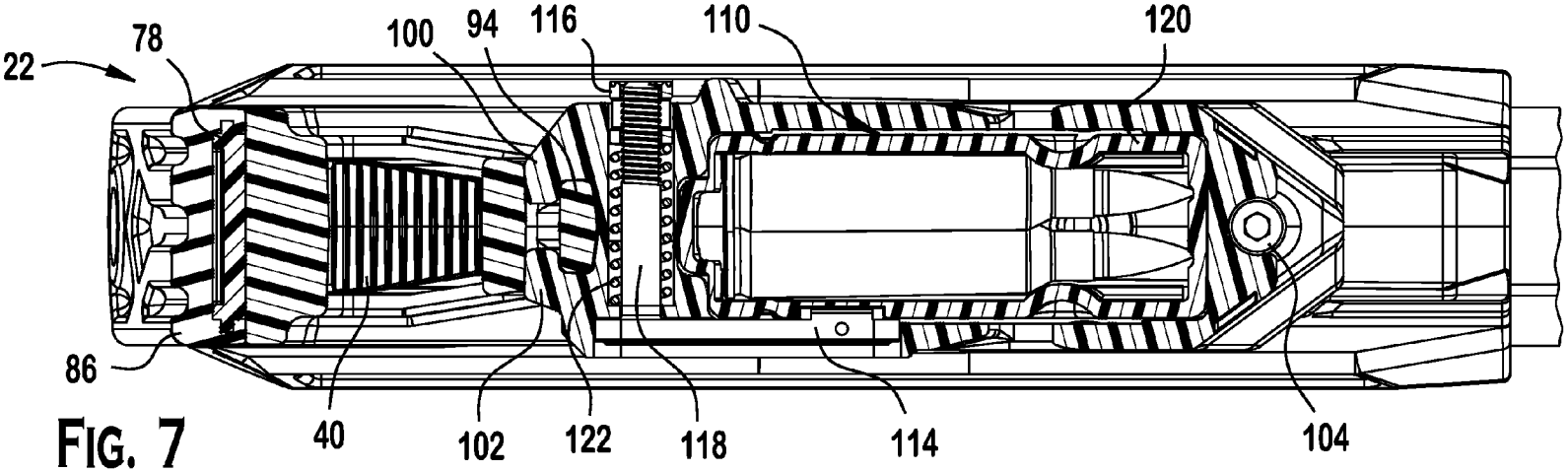
FIG. 7 is a cross-sectional view of the stock and DAH of FIG. 1, along line 7-7 of FIG. 5.
Figure 9:
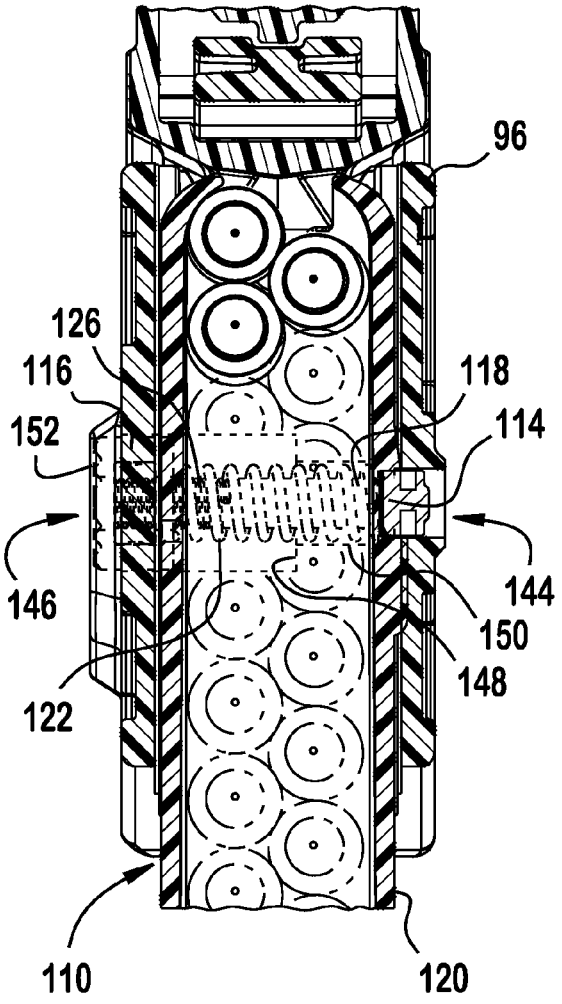
FIG. 9 is a cross-sectional view of the stock and DAH of FIG. 1, along line 9-9 of FIG. 5.

In the embodiment shown in FIG. 11, the channel 98 of the DAH 96 may be slid onto the accessory mounting rail 94 until the top of the DAH contacts the lower portion of the stock frame. A threaded fastener 104 may be inserted into the DAH fastener receiving bore 106 and advanced into a mating fastener attachment site 108 in the stock frame to lock the items together. An accessory well 110 open at the bottom of the DAH may be used to receive a tactical accessory such as a magazine. The interior side wall 106 of the accessory well 110 may be configured and dimensioned to receive a particular type of magazine. Referring to FIG. 6, the interior side wall 112 of the accessory well may include an accessory latch catch 114 for securing the accessory in the well. Referring to FIGS. 7, 9 and 12, pressing the DAH release button 116 may translate the DAH latch stem 118 and move the DAH latch catch 114 out of the accessory well to allow an accessory (e.g., a magazine) 120 to be removed from the accessory well 110. FIGS. 2, 3, 4 and 6 show various views of the DAH secured to the stock.

Referring to FIG. 12, the DAH latch may further include a compression spring. The DAH latch compression spring may be seated around the DAH latch stem and may be positioned between the DAH catch 114 and the DAH release button 116 so as to bias the DAH release button 116 outward while at the same time pulling the DAH latch catch 114 into the accessory well. In this manner, the DAH latch may be biased into an accessory locking configuration. The DAH latch assembly may be repurposed from a standard AR-15 magazine catch assembly.

Figure 13:
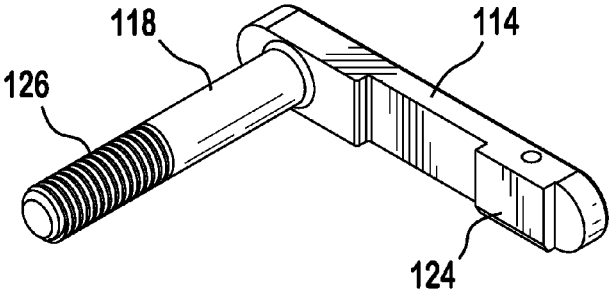
FIG. 13 is a perspective view of the DAH latch of FIG. 12.
Figure 14:
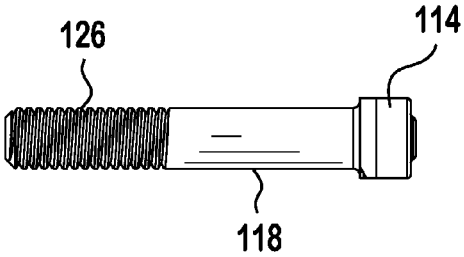
FIG. 14 is a side view of the DAH latch of FIG. 13.
Figure 15:
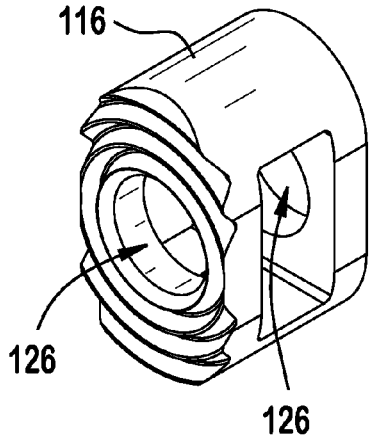
FIG. 15 is a perspective view of the DAH release button of FIG. 12.
Figure 16:
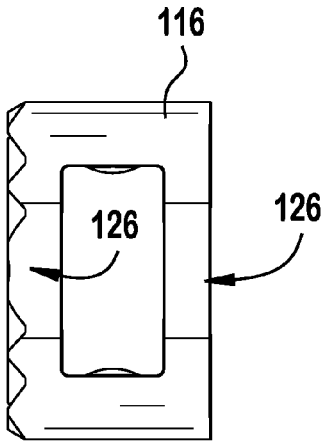
FIG. 16 is a side view of the DAH release button of FIG. 15.

Referring to FIG. 13, the DAH latch catch 114 and DAH latch stem 118 may form an L-shaped member. A projection 124 on the DAH latch catch 114 may be adapted to interlock with an opening on the accessory 120 in order to retain the accessory in the DAH accessory well. As shown in FIGS. 13 and 14, the DAH stem 118 may be threaded. Referring to FIG. 12, the screw threads 126 may be configured and dimensioned to mate with a bore(s) 126 on the DAH latch release button 116. Various views of the latch release button, including two DAH stem attachment bores 126, are presented in FIGS. 15 and 16.

Although the detachable accessory housing (DAH), in this embodiment may be configured and dimensioned to hold a magazine for an AR-15 type weapon, the DAH may take any suitable form for securing or holding an accessory, provided the DAH is secured to the mounting rail 96 or the fastener attachment site 108 near the distal end of the stock. For example, the DAH may take the form of a closed container with one or more openings and a similar number of mating waterproof covers, which may be used to store spare parts, batteries or other equipment.

Figure 4:
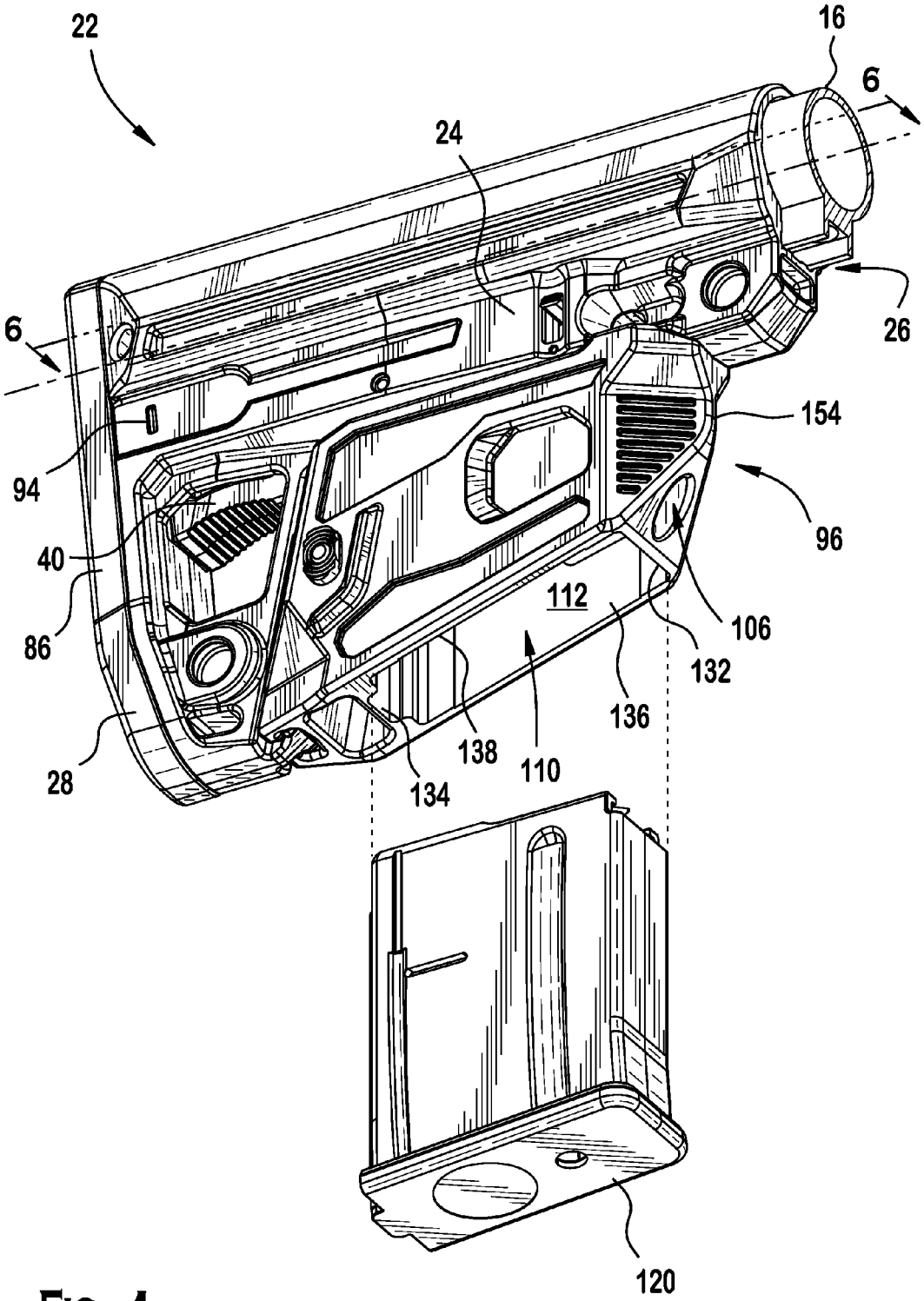
FIG. 4 is a perspective view of the stock of FIG. 3 with the magazine removed from the DAH.

In the illustrative embodiment of FIGS. 4, 11 and 12, the DAH 96 may include a DAH cradle 128 and latch 130. The DAH cradle 128 may form a body which connects to the stock and which holds the accessory. For example, the DAH 96 may include a hollow member with multiple sides (e.g., a front side 132, rear side, 134, port side 136, and starboard side 138).

As shown in FIG. 12, the DAH also may include an open top portion 140. The DAH cradle may include a port side window 142, a starboard side window 144, a DAH fastener bore opening 106, a DAH latch catch opening 144, a DAH latch release button opening and a stem opening 146 (FIG. 9). The DAH latch stem opening 146 (FIG. 12) may include an outer end wall and an inner end wall. Additionally, as shown in FIGS. 10 and 11, the DAH latch release button opening may be partially surrounded by a raised surface or guard 152 to prevent inadvertent release of the DAH latch.

Referring to FIG. 12, the DAH cradle 128 further may include a DAH fastener bore 106 near the distal end of the device and a receiving channel 98 near the proximal end of the device. As previously described, these structures may be used to secure the DAH 96 to the stock. As shown in FIG. 11, the nose of the DAH cradle 128 may be tapered to streamline the profile of the storage device. As shown in FIG. 12, the DAH cradle 128 further may include a stock mating surface 156 which is configured and dimensioned to securely interface with the corresponding profile of the stock to promote a tight fit.

Figure 19:
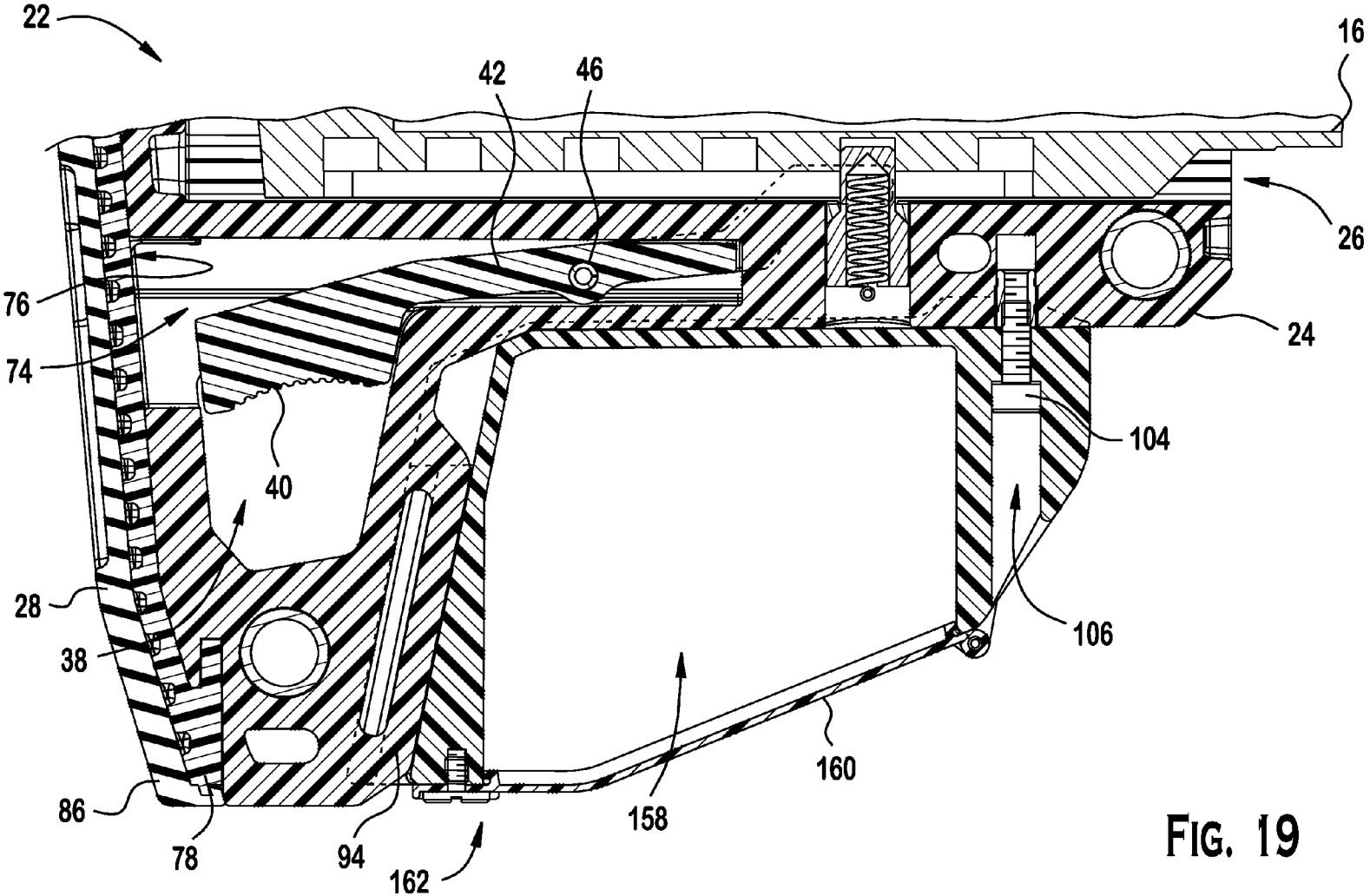
FIG. 19 is a cross-sectional view of the stock and another embodiment of the DAH of FIG. 1, along line 5-5 of FIG. 3.

Referring to FIG. 19, the detachable accessory housing (DAH) 96 may include an internal compartment 158 and a cover 160 to form a closed container 162. Although the cover 160 shown in FIG. 19 may be a hinged cover, other cover configurations such as a plug, a screw top, or locking cover may be used, as long as the cover provides a secure and reliable mechanism for closing the internal compartment. The closed container 162 may be water resistant or water proof.

Also, the DAH may have a shape or configuration other than as disclosed in FIG. 5 or 19. For example, a DAH may be circular cylindrical in shape, and may include a screw thread proximate the open end of the internal compartment. A round cap with an internal sealing element (e.g., O-ring) and mating screw threads may be secured to the circular cylindrical DAH to form a waterproof container.

Referring to FIG. 1, the stock 22 may be configured for modular attachment to an M4 or an AR-15 type firearm 10. The receiver extension attachment site 26 may be configured and dimensioned, however, to connect with receiver extensions 16 of other small arms weapons. In a preferred embodiment the stock 10 may be a fiber-reinforced polymer, such as nylon 6/6 with 30% glass, carbon or aramid fiber threads, but other strong and durable materials may be used.

In use, the locking pin of the stock may be retracted with the lever, and the receiver extension may be slid into the receiver extension attachment site. The receiver extension may be advanced into the stock until a set position (or locking pin hole) has been selected by the user. The lever then may be released and the stock manipulated until one locking pin hole in the bottom of the receiver extension interlocks with the locking pin. The DAH may be secured to the stock and an accessory (e.g., a loaded ammunition magazine) may be stored in the DAH. The magazine may be removed by pressing the DAH latch release button and withdrawing the magazine from the cradle.

While it has been illustrated and described what at present are considered to be preferred embodiments of the present invention, it will be understood by those skilled in the art that various changes and modifications may be made, and equivalents may be substituted for elements thereof without departing from the true scope of the invention. Accordingly, it is intended that this invention not be limited to the particular embodiments disclosed herein, but that the invention include all embodiments falling within the scope of the appended claims.

What is claimed is:

1. A stock for a small arms weapon comprising:

a frame having a longitudinal axis which comprises a fore-end which comprises a receiver extension attachment site opening, and a butt which is spaced from the fore-end along the longitudinal axis, and which comprises an upper area aligned with the receiver extension attachment site opening, an intermediate area situated next to the upper area, the intermediate area comprises a rear opening having a Y-shaped cross-section transverse to the longitudinal axis, and a lower area disposed below the intermediate area, the lower area comprises a butt plate attachment site, a body disposed between the fore-end and the butt, the body comprises an upper surface extending from the upper area to the fore-end, a lower surface extending from the lower area to the fore-end, the lower surface defining a profile which comprises a forward facing segment and a bottom facing segment which intersect to form a step with respect to the longitudinal axis, the forward facing segment including an accessory mounting rail, a cylindrical cavity which is situated in the body between the upper surface and the lower surface, and which is bounded by a sidewall and a track that are disposed between the receiver extension attachment site and the upper area such that the cylindrical cavity is configured and dimensioned to telescopically receive a receiver extension tube from the receiver extension attachment site opening, a lever receiving cavity connected to the rear opening and extending toward the fore-end, a bore intersecting the lever receiving cavity and the cylindrical cavity, and a stock latch lever pivotally disposed in the lever receiving cavity, a locking pin situated in the bore, the locking pin extending from the lever receiving cavity into the cylindrical cavity such that the locking pin is operatively associated with the stock latch lever to selectively withdraw the locking pin from the cylindrical cavity, and a detachable accessory housing mounted on the accessory mounted rail, the detachable accessory housing being fixed to the frame.

2. The stock of claim 1, wherein the intersection of the forward facing segment and the bottom facing segment defines an oblique angle.

3. The stock of claim 2, wherein the oblique angle is an obtuse angle.

4. The stock of claim 1, wherein the detachable accessory housing comprises an accessory mounting rail attachment site.

5. The stock of claim 4, wherein the accessory mounting rail attachment site comprises a channel, a port side retention member adjacent the channel, and a starboard side retention member opposite the port side retention member such that the channel, the port side retention member, and the starboard side retention member are configured and dimensioned to slidably mate with the accessory mounting rail.

6. The stock of claim 1, wherein the detachable accessory housing comprises an accessory well.

7. The stock of claim 6, wherein the detachable accessory housing comprises an accessory latch that includes first and second operable configurations, such that in the first operable configuration the accessory latch projects into the accessory well, and in the second operable configuration the latch is withdrawn from the accessory well.

8. The stock of claim 7, wherein the accessory latch comprises a catch, a stem connected to the catch, a release button connected to the stem, and a resilient member disposed about the stem between the release button and the catch such that the resilient member biases the catch into the first configuration.

9. The stock of claim 8, wherein the detachable accessory housing is fixed to the bottom facing segment by a fastener.

10. The stock of claim 9, wherein the accessory well comprises a four-sided compartment.

11. The stock of claim 10, wherein the four-sided compartment is configured and dimensioned to receive a box magazine.

12. The stock of claim 11, further comprising a box magazine in the four-sided compartment.

13. The stock of claim 12, wherein the box magazine has a maximum capacity of ten rounds.

14. The stock of claim 1, further comprising a back plate secured to the butt.

15. The stock of claim 14, wherein the back plate comprises a first side which faces the stock, and a second side which faces away from the stock, the first side including a hook which is configured and dimensioned to be received in the butt plate attachment site, and the second side including an over molded layer of resilient material.

16. The stock of claim 1, wherein the detachable accessory housing is fixed to the frame with a fastener.

17. The stock of claim 16, wherein the fastener is a screw.

18. The stock of claim 1, wherein the frame further comprises a bushing which is configured and dimensioned to receive a sling attachment fitting.

19. The stock of claim 1, wherein the receiver extension attachment site opening is configured and dimensioned to receive a receiver extension of an AR-15 type firearm.

20. The stock of claim 1, further comprising a box magazine connected to the detachable accessory housing.

* * * * *